United States Patent [19]

Fapiano

[11] Patent Number: 4,487,044

[45] Date of Patent: Dec. 11, 1984

[54] FRICTION COMPENSATION IN A ROLLING MILL HAVING AUTOMATIC GAGE CONTROL

[75] Inventor: Donald J. Fapiano, Salem, Va.

[73] Assignee: General Electric Company, Salem, Va.

[21] Appl. No.: 509,599

[22] Filed: Jun. 30, 1983

[51] Int. Cl.[3] ..... B21B 37/12

[52] U.S. Cl. ..... 72/8; 72/20; 364/472

[58] Field of Search ..... 364/472; 72/8, 19, 20, 72/21, 16, 237, 240

[56] References Cited

U.S. PATENT DOCUMENTS

| | | | |
|---|---|---|---|
| 3,081,652 | 3/1963 | Wright et al. | 72/240 X |
| 3,613,419 | 10/1971 | Silva | 72/16 X |
| 3,704,609 | 12/1972 | Sterret, Jr. | 72/19 X |
| 3,787,667 | 1/1974 | King et al. | 72/8 X |

OTHER PUBLICATIONS

"Mill Modulus Variation and Hysteresis—Their Effect on Hot Strip Mill AGC", by G. E. Wood et al., *Iron and Steel Engineer Yearbook,* 1977—pp. 33–39.

"Force Sensing in Rolling Mills", by A. Zeltkalns et al., *Iron and Steel Engineer Yearbook,* 1977—pp. 40–46.

*Primary Examiner*—Lowell A. Larson
*Assistant Examiner*—Steven B. Katz
*Attorney, Agent, or Firm*—Arnold E. Renner

[57] ABSTRACT

A rolling mill stand which includes roller elements for reducing the thickness of a workpiece which is passed therebetween further includes an adjusting mechanism for adjusting the gap between the roller elements and a sensor for sensing the roll separation force occasioned by passing the workpiece between the roll elements. The stand also includes a sensor for sensing the roller elements position and an automatic gage control device for controlling the gap adjustment mechanism as a function of the roll separation force. Associated with the rolling mill stand is a method of compensating for friction forces within the rolling mill stand occuring as a result of movement of the roller elements so as to improve the accuracy and stability of the automatic gage control.

20 Claims, 4 Drawing Figures

FRICTION COMPENSATION IN A ROLLING MILL HAVING AUTOMATIC GAGE CONTROL

BACKGROUND OF THE INVENTION

The present invention relates generally to rolling mills and more particularly to a method of compensating for friction in a metal rolling mill stand having automatic gage control to control the output gage (thickness) of a metal strip or workpiece.

One well known method of controlling workpiece gage is that which is commonly referred to as the BISRA gagemeter automatic gage control (AGC) system. In this system, the force associated with and generated by the workpiece as it is passed through the stand work rolls is sensed and combined with a signal proportional to roll position to form a signal representative of workpiece thickness which is used in a closed loop system to adjust the gap or opening between the opposed work rolls.

In applications where incoming workpiece hardness and thickness variations are less significant than mill roll irregularities, such as eccentricity or ovalness, the thickness control strategy may be based upon regulation of rolling force on the assumption that constant rolling force will produce uniform output thickness.

In practice these systems have not been as accurate as might be anticipated and one of the primary causes of inaccuracies is friction. As is well known in the art, friction exists between the mill stand housing and the chocks which support the rolls as well as in certain hydraulic elements such as balancing jacks which are used to maintain the roll chocks in position and, where used, the hydraulic roll gap adjustment mechanism. Since both gagemeter and force control systems employ the use of a force feedback signal, it is apparent that any forces seen by the force sensor in addition to those forces produced by reduction of the workpiece will tend to degrade the accuracy of that force signal as a true representation of the actual rolling force. It must be remembered that in all gage control systems the gap between the rolls is repeatedly being changed in an attempt to effect constant output gage as a function of the force feedback signal.

It is also recognized in the art that the frictional forces within the mill stand are additive with respect to the actual workpiece rolling force while the rolls are being moved in a first direction and are subtractive when the rolls are being moved in the opposite direction. This, in effect, produces in a condition generally referred to as hysteresis.

The amount of such hysteresis is a function of the relative centerline positions of work and backup rolls, referred to as roll "offset", the rolling force level, the forward and backward acting workpiece tensions, the backup roll bearing lubrication, the mill window and bearing chock surface condition and lubrication, and the roll balance jack seal condition. Any of these is subject to change, particularly with a change in roll chocks, making prediction of friction forces very difficult.

Because of these frictional forces, without some form of friction compensation, the AGC system is at best inaccurate and, in the worst case, unstable. An example of unstable operation is that resulting from frictional forces in gagemeter systems where force sensor and actuator are on the same side of the roll bite. In this arrangement, the friction force causes the roll position to overshoot in both directions of travel. As a result, it has been the practice of many operators of such systems to detune the control to produce less than complete correction of sensed gage errors. This improves stability but decreases accuracy.

While it is apparent that there is a preferred location for the force sensor with respect to the roll position actuator for a given gage control strategy, the choice may be complicated where both gagemeter and constant force control modes are used. The preferred force sensor location for one mode will produce unstable operation in the other mode, in the presence of substantial friction. Even where the force sensor is in the preferred location, large amounts of friction cause the thickness control system to under correct, resulting in inaccurate, although stable, operation.

As earlier indicated, the friction forces and the hysteresis effect thereof are well known in the art and for a more complete discussion thereof, reference is made to the following two articles:

(a) "Mill modulus variation and hysteresis—Their effect on hot strip mill AGC" by G. E. Wood et al., *Iron and Steel Engineer Yearbook,* 1977, pages 33 through 39; and, (b) "Force sensing in rolling mills" by A. Zeltkalns et al., *Iron and Steel Engineer Yearbook,* 1977, pages 40 through 46.

SUMMARY OF THE INVENTION

It is, therefore, an object of the present invention to provide a method for compensating for friction within a stand of a rolling mill.

It is a further object to provide, in a rolling mill employing an automatic gage control system, a method of friction compensation to thereby enhance the accuracy and stability of a gage control system.

It is another object of the present invention to provide, in a rolling mill having automatic gage control, a method of friction compensation which includes consideration of friction changes attributable to variations in roll loading and tension in the workpiece being rolled.

The foregoing and other objects are achieved by providing a rolling mill stand which includes roller elements for reducing the thickness of a workpiece passed therebetween, means for adjusting the gap between the roller elements, and additional means for sensing the roll separation force occasioned by the passing of the workpiece between the roller elements and means for sensing the roller elements' position. Associated with this mill stand, in accordance with the present invention, is an automatic gage control means such as a BISRA gagemeter system for controlling the roll gap as a function of roll separation force. The force signal which is applied to the automatic gage system in accordance with the present invention is derived by sensing the apparent rolling force and compensating that sensed value for frictional forces within the rolling mill stand which occur during movement of the roller elements. The compensating value, once derived, is combined with the apparent or sensed force signal in a first direction when the rolls are being moved in a first direction and subtracted therefrom when the rolls are being moved in a second direction.

The invention also contemplates friction compensation as a function of the roll load; i.e., the force applied to the workpiece.

BRIEF DESCRIPTION OF THE DRAWING

While the present invention is specifically defined in the claims annexed to and forming a part of this specification, a better understanding of the invention can be had with reference to the following description taken in conjunction with the accompanying drawings in which:

DETAILED DESCRIPTION

Figure 1:
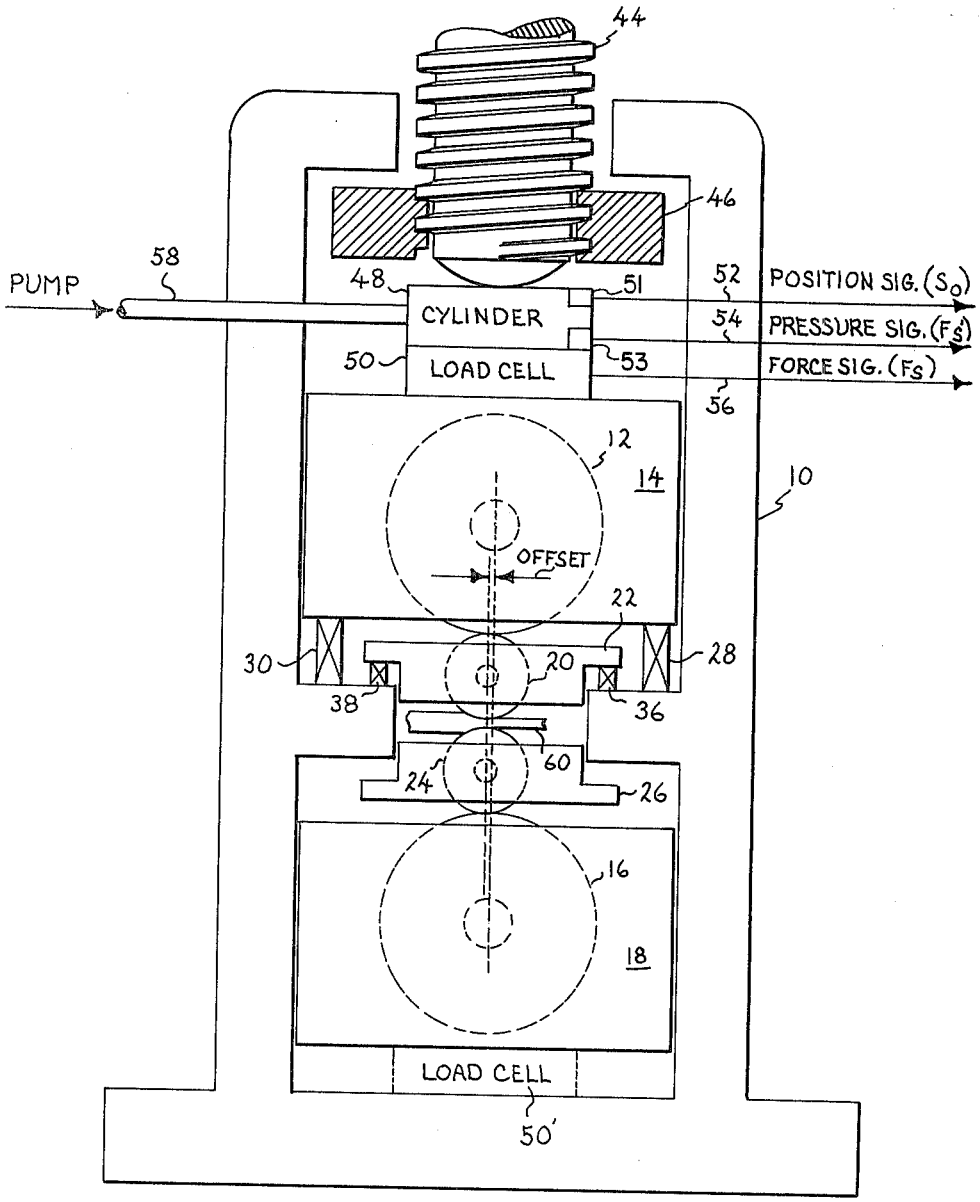
FIG. 1 is a schematic end view of a typical mill stand useful in understanding the present invention.

Reference is now made to FIG. 1 which shows in schematic form the end view of a typical four-high mill stand. As illustrated, the stand has a housing 10 for containing the stand elements which include an upper backup roll 12 which is journaled in a suitable chock means 14. A lower backup roll 16 is similarly journaled in a chock 18. A pair of workrolls shown at 20 and 24 are journaled in respective chocks 22 and 26. Two pairs of balance jacks serve to support the upper chocks with respect to the mill housing. Thus, the first pair of balance jacks 28 and 30 is positioned between the housing and the upper backup roll chock 14. Workroll balance jacks 36 and 38 support the upper workroll chock 22. Similar chocks and jacks would, of course, exist on the other end of the stand.

As is customary, a suitable screw mechanism 44 acting through a nut 46 serves to provide rough dimensioning of the space (gap) between the two workrolls 20 and 24 through which a workpiece 60 is passed. In the present illustration there is further included, immediately below the screw 44, a hydraulic system illustrated at 48 which is essentially a piston within a cylinder, (herein referred to as the "cylinder") which will, as is known in the art, serve to provide adjustment in accordance with the automatic gage control (AGC) system. It is also known that the cylinder can be omitted and have the AGC work directly through the screw 44. The screw 44 and cylinder 48 act upon the backup roll chock 14 by way of a load cell 50. The load cell, as is well recognized in the art, provides an output force signal (signal on $F_s$ line 56), which is proportional to the rolling force resulting from the workpiece 60 being passed between the workrolls 20 and 24 as modified by the friction forces here being discussed. (Depicted in phantom form at the bottom of the stand between the lower backup roll chock 18 and the housing is a load cell 50'. This is meant to show an alternate location of the load cell which is sometimes employed.)

Associated with the cylinder 48 are two sensing means 51 and 53 which are commonly provided with the cylinder. Sensing means 51 provides the output signal ($S_o$) on line 52 which is indicative of the position of the piston within the cylinder and hence an indication of the roll gap. Sensor 53 is a pressure sensor which senses the internal pressure within the cylinder and provides a pressure signal ($F_s'$) on output line 54 which may also be utilized as an indication of the rolling force. Hydraulic fluid is supplied to the cylinder 48 by way of a suitable pump under the control of the AGC system and by way of a suitable connection shown at 58 as will be more fully explained with respect to FIG. 4.

A final feature to be mentioned with respect to FIG. 1 is that, as indicated, the centers of the workrolls are offset from the centers of the backup rolls by some small amount, for example one-quarter inch, to lend stability to the overall mill system. The overall depiction of FIG. 1 is one which is very common in the art and well understood by those versed therein.

The frictional forces with which the present invention is concerned originate primarily in two general areas. The first of these areas is in hydraulic systems; i.e., the cylinder 48 and the balance jacks which support the backup and workroll chocks. These jacks are normally hydraulic jacks, and like system 48 have a piston working through a seal. In view of the pressures necessary within the overall system, the friction between the piston and the seal can be quite severe. In addition, and probably even to greater effect, is the friction of the roll chocks as they are moved and slide along the interior sides (the window) of the mill housing. These latter friction forces are better understood with respect to FIG. 2.

Figure 2:
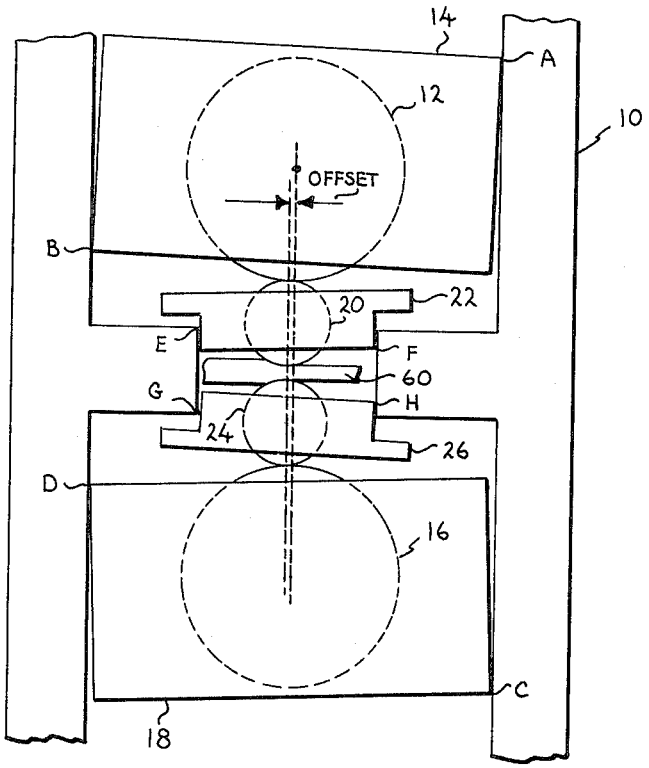
FIG. 2 is a schematic view of a portion of a mill stand having certain features and effects exaggerated for purposes of illustration in the explanation of the present invention.

FIG. 2 illustrates a portion of the elements of FIG. 1 and has certain features exaggerated for purposes of illustration. As can be seen in FIG. 2, when a workpiece 60 is positioned between the workrolls 20 and 24, the roll chocks tend to disalign or skew themselves with respect to the mill housing such that point contacts A through H tend to develop between these chocks and the housing. From this illustration, it is seen that with any movement of the chocks against the housing, such as when the roll position is varied for gage control purposes, friction forces will be developed which will be sensed by the force sensors; e.g., the load cell 50 (or 50') or the pressure sensor 53 (FIG. 1). The signal from the sensor is that used in the AGC system as is well known. These frictional forces can be considerable, often in the range of 1.0–5.0 percent of the total force sensed by the sensing means, and can seriously degrade the overall AGC system. As noted earlier, these friction forces are not constant since they depend upon the condition of the window (sides) of the mill housing and roll chocks, the degree of lubrication, and other factors.

As was also previously noted, the frictional forces act with respect to the overall sensed force in different directions according to the location of the force sensing means and the direction of chock or roll travel. When the force sensing means and the means for adjusting the roll gap are on the same side of the roll gap, the friction forces due to the chocks contact with the mill housing, those associated with the balance jacks and those associated with the cylinder will all add to the actual roll separation force as seen by the force sensor when the mill roll gap is being closed and will subtract from the actual force when the gap is being increased. Conversely, when the sensor is on the opposite side of the roll gap from the gap adjusting such as indicated by FIG. 1, load cell 50', only the frictional forces associated with the bottom roll chocks need to be considered and these will subtract from the actual force when the mill is closing and will add to the actual force when the mill is opening.

Mathematically, in the first case explained, the case of the sensor being on the same side of the roll gap as the gap adjusting means and with the mill in the closing operation, the sensed force can be expressed as:

$$F_S = F_R + f_{brb} + f_{wrb} + f_c + f_h$$

wherein, $F_S$ = total force sensed by sensor 50 (or sensor 53)

$F_R$ = actual roll separation force occasioned by workpiece between the rolls $f_{brb}$ = frictional force of backup roll balance jacks $f_{wrb}$ = frictional force of workroll balance jacks $f_c$ = frictional force of cylinder $f_h$ = frictional force of upper roll chocks moving against stand housing.

For the above mill stand while the roll gap is being increased, the relationship is:

$$F_S = F_R - f_{brb} - f_{wrb} - f_c - f_h$$

For a mill stand with the sensor on the opposite of the roll opening from the adjustment means the relationships reduce to:

$$F_S = F_R - f_{lh} \text{ (closing), and,}$$

$$F_S = F_R + f_{lh} \text{ (opening)}$$

wherein, $f_{lh}$ = frictional force of lower roll chocks moving against stand housing.

It must be recognized that the foregoing relationships are applicable only to dynamic conditions in which the roll gap is being changed at some velocity above some empirically derived predetermined minimum. At very slow roll gap changing speeds, the vibration within the stand as the workpiece is being rolled will render the frictional forces ineffective, insofar as sensed by the force sensing means. With stationary conditions, of course, there are no frictional forces. These friction forces do become significant above some predetermined velocity, normally in the range of 0.001 inch per second but actually dependent on the source of friction and the degree of mill vibration.

Figure 3:
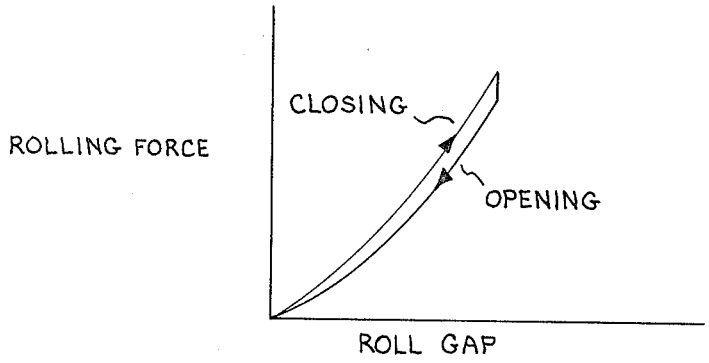
FIG. 3 is a graph illustrating the hysteresis effect of friction in a rolling mill stand; and, FIG. 4 is a logic diagram showing the compensation scheme of the present invention.

FIG. 3 illustrates the hysteresis effect which was earlier mentioned and which is exemplified by the equation pairs above. FIG. 3 plots the sensed rolling force against the changing roll gap from an actual mill test and it is seen that, as is apparent from the two equations, the rolling force differs in opening and closing.

Factors earlier alluded to but not previously discussed are the affects of friction in the backup roll bearings and tension in the workpiece. While these factors do not seriously affect the value of the frictional forces associated with the balance jacks, they do affect the frictional forces which are occasioned by the chocks moving against the stand housing. The actual attitude assumed by the backup and workroll chocks is dependent on the relative magnitudes of front and back workpiece tensions, the couple produced by the rolling force acting through the roll offset, and the torque required to rotate the backup roll in its bearings. Changes in this attitude, as well as the magnitude of tensions and rolling force, will influence the effective mill friction.

From the foregoing discussion it is apparent that frictional forces can seriously degrade the accuracy and validity of any sensed forced signal for use in an automatic gage system. The basic problem then is to develop a representation of the frictional forces involved and utilize it to improve the sensed force signal. One means of developing this representation is to operate the mill stand a number of times without a workpiece between the rolls and to measure the forces observed. While this will provide some value for frictional forces, it does not consider the earlier described effects of mill loading and tension in the workpiece. The preferred embodiment, therefore, is to take an average of frictional forces under actual operating conditions; that is, to retain and to average the force variations observed over a selected number of opening and closing operations of the mill stand. Mathematically, this can be expressed as follows:

$$2 \cdot f_1 = \frac{1}{N_d} \sum_{i=1}^{i=N_d} F_i \Big|_{v<-VT} - \frac{1}{N_w} \sum_{i=1}^{i=N_w} F_i \Big|_{v>+VT}$$

wherein:

$f_1$ = friction signal $N_d$ = number of scans in closing direction $N_w$ = number of scans in opening direction $F_i$ = sensed force signal values $v$ = gap change velocity $V_T$ = gap change velocity threshold Since the value of $f_1$ achieved in accordance with the latter method is derived from actual operating conditions, it represents a better evaluation of the frictional forces than the earlier described method. It is believed apparent that the computation defined by the immediately above formula could be performed by analog means. Preferably, however, this computation is achieved in a microprocessor or some form of data processing unit.

Figure 4:
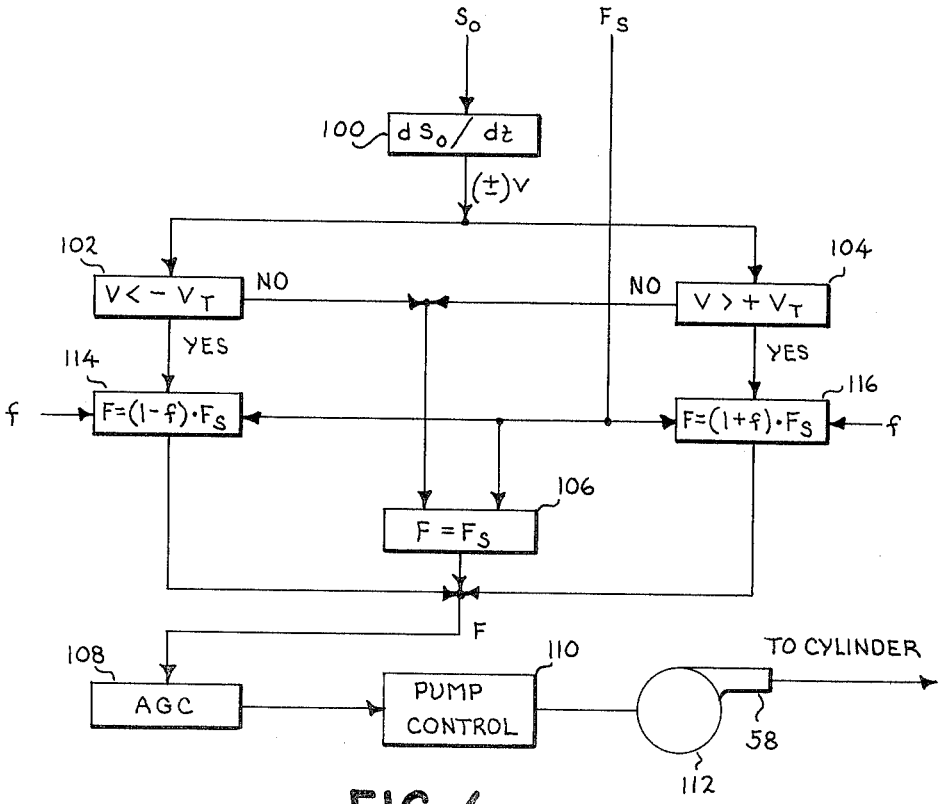

The relationship given above for $f_1$ will be in units of force. A more practical mode of expression in some applications, such as that which follows with respect to FIG. 4, is in per unit values. One means of developing such a per unit value is to develop an average force value ($F_{avg}$) and to derive from that a per unit force value (f) in accordance with the following relationships:

$$F_{avg} = \frac{1}{N_d + N_w} \sum_{i=1}^{i=N_d+N_w} F_i, \text{ and } f = \frac{f_1}{F_{avg}}$$

Assuming that a per unit frictional force, f, has been determined which is representative of the actual current frictional forces associated with the mill stand, the problem remaining is to employ this signal to adjust the sensed force signal to an actual force signal to be used by the AGC system of the mill in controlling of the roll gap adjusting means. One method by which this may be achieved is illustrated in FIG. 4. The signs in FIG. 4 represent the situation where the force sensing means and the roll gap adjusting means are on the same side of the roll gap. It should be noted that in the situation of a force sensor located on an opposite side of the gap from the roll gap adjusting means, such as illustrated by the load cell 50' in FIG. 1, mathematical relationship of blocks 114 and 116 would be interchanged.

Referencing now that Figure, it is seen that a signal $S_o$, the position signal from the sensor 51 of cylinder 48 in FIG. 1, is applied to a differentiating block 100 which provides as its output a signal which is indicative of the roll changing velocity and has a polarity, plus or minus, in accordance with the direction in which the roll gap is changing. This signal designated (±)v is applied to two logic blocks 102 and 104 which determine, respectively, whether the velocity signal v is less than minus some terminal velocity $V_T$ (block 102) or greater than the positive value of $V_T$ (block 104). If the logic decision of both blocks 102 and 104 is "No" the force sensed is the force actually used and this signal is then applied, as indicated by block 106, to an AGC system 108. The AGC system, in turn, applies a signal to a pump control 110 to control a pump 112 which supplies pressure to the cylinder 48 (FIG. 1) by means of line 58. Assuming that the output of block 100, signal v, has a negative value less than $-V_T$ (roll gap is decreasing) then, as shown by block 114, that the actual force signal F to be supplied to the AGC is equal to the sensed force ($F_s$) times the quantity of $1-f$. The other condition for this particular set of circumstances is that the velocity signal v is greater than $+V_T$ (roll gap is increasing). In this case, as shown by block 116 the force signal to be supplied by the AGC system is equal to the actual sensed force times the quantity $(1+f)$. Since f is a per unit quantity, the variation in friction force with rolling force level is automatically accomodated by this method.

For clarity, the logic relating to the application and removal of the friction signal, f, has been shown in FIG. 4 in its simplest workable form. A modified embodiment would permit the friction signal, f, to decay exponentially from the level existing when the velocity signal v falls beneath the threshhold VT in either direction. This more closely approximates the actual decay of friction in the mill elements. The decay time constant can be estimated from simple field tests and is typically of the order of 0.3 to 1.0 seconds. One method of achieving this modified embodiment is to use a per unit friction signal which is defined by the relationships:

$$f=f_{max} \text{ when } |v| \geqq |V_T|;$$

and $$f=f_{max} \cdot e^{-t/T} \text{ when } |v| < |V_T|;$$

wherein, $f_{max}$=per unit friction signal maximum value
v=gap change velocity
$V_T$=gap change velocity threshhold
t=time elapsed since $|v|$ fell below $|V_T|$
T=friction decay time constant
f=per unit friction signal
e=mathematical constant.

While changes in tension will cause changes in $f_1$ and, therefore, in f, it is generally adequate to ignore tension changes, leaving the on-line estimation procedure to adjust for tension change effects.

FIG. 4, as was earlier indicated, is a logical description of the operations to be performed in accordance with the present invention. It is readily apparent to those skilled in the art that these functions could be performed either by analog circuitry or by data processing equipment with comparable results. It is believed, however, that in today's state of the art, the data processing or digital system would be preferable in which case it is apparent that the two signal $S_o$ and $F_s$ as well as the friction signals f would have to be digitalized.

While there has been shown and described what are at present considered to be the preferred embodiments of the present invention, modifications thereto will readily occur to those skilled in the art. It is not desired, therefore, that the present invention be limited to the embodiments disclosed and described and the appending claims are, therefore, intended to cover all such modifications as fall within the true spirit and scope of the invention.

What is claimed is:

1. In a rolling mill stand including roll elements for reducing the thickness of a workpiece passed therebetween, means for adjusting the gap between the roll elements, means for sensing the roll separation force occasioned by passing the workpiece between the roll elements, means for sensing the roll elements position and automatic gage control means for controlling the means for adjusting the gap as a function of roll separation force, a method of compensating for friction forces within the rolling mill stand occuring as the result of movement of the roll elements so as to improve the stability and accuracy of said automatic gage control comprising the steps:

(a) establishing a friction signal representative of the friction forces;
(b) developing a sensed force signal representing the sensed roll separation force occasioned by passing a workpiece between said roll elements;
(c) developing a velocity signal having a sense and a magnitude representing the velocity of the change of the roll gap; and,
(d) combining said friction signal and said sensed force signal as a function of the sense and magnitude of said velocity signal to provide a compensated force signal for use by the automatic gage control means in controlling the roll gap.

2. The method in accordance with claim 1 wherein said step of combining said friction signal and said sensed force signal occurs only when said velocity signal has a magnitude in excess of some predetermined value.

3. The method in accordance with claim 1 wherein, in a mill stand having the means for adjusting the gap and the means for sensing the roll separation force on the same side of the roll gap, the step of combining includes subtracting the friction signal from the sensed force signal when the roll gap is being deceased and adding the friction signal to the sensed force signal when the roll gap is being increased.

4. The method in accordance with claim 2 wherein, in a mill stand having the means for adjusting the gap and the means for sensing the roll separation force on the same side of the roll gap, the step of combining includes subtracting the friction signal from the sensed force signal when the roll gap is being decreased and adding the friction signal to the sensed force signal when the roll gap is being increased.

5. The method in accordance with claim 1 wherein, in a mill stand having the means for adjusting the gap and the means for sensing the roll separation force on opposite sides of the roll gap, the step of combining includes adding the friction signal to the sensed force signal when the roll gap is being decreased and subtracting the friction signal from the sensed force signal when the roll gap is being increased.

6. The method in accordance with claim 2 wherein, in a mill stand having the means for adjusting the gap and the means for sensing the roll separation force on opposite sides of the roll gap, the step of combining includes adding the friction signal to the sensed force signal when the roll gap is being decreased and subtracting the friction signal from the sensed force signal when the roll gap is being increased.

7. The method in accordance with claim 1 wherein said friction signal is established by averaging the difference in the sensed roll separation force signals obtained while opening and closing at a velocity in excess of a predetermined magnitude with no workpiece between the roller elements.

8. The method in accordance with claim 1 wherein said friction signal is established by combining the average of sensed force signals derived while the roll gap is closing at a velocity exceeding a predetermined magnitude with the average of the sensed force signals derived while the roll gap is opening at a velocity exceeding a predetermined magnitude, during a predetermined period of time while the workpiece is being rolled.

9. The invention in accordance with claim 8 wherein said friction signal is established in accordance with the relationship:

$$2 \cdot f_1 = \frac{1}{N_d} \sum_{i=1}^{i=N_d} F_i \Big|_{v<-VT} - \frac{1}{N_w} \sum_{i=1}^{i=N_w} F_i \Big|_{v>+VT}$$

wherein:

$f_1$=friction signal
$N_d$=number of scans in closing direction
$N_w$=number of scans in opening direction
$F_i$=sensed force signal values
v=gap change velocity
$V_T$=gap change velocity threshhold.

10. The invention in accordance with claim 1 wherein said friction signal includes a value attributable to the level of sensed roll separation force.

11. The invention in accordance with claim 8 wherein said friction signal is defined as the product of the per unit of the average of sensed force signals derived over said predetermined time period and said average of sensed force signals.

12. The invention in accordance with claim 11 wherein, in a mill stand having the means for adjusting the gap and the means for sensing the roll separation force on the same side of the roll gap, the step of combining the friction and sensed force signals includes subtracting the friction signal from the sensed force signal when the roll gap is being decreased and adding the friction signal to the sensed force signal when the roll gap is being increased.

13. The method in accordance with claim 11 wherein, in a mill stand having the means for adjusting the gap and the means for sensing the roll separation force on opposite sides of the roll gap, the step of combining the friction and sensed force signals includes adding the friction signal to the sensed force signal when the roll gap is being decreased and subtracting the friction signal from the sensed force signal when the roll gap is being increased.

14. The invention in accordance with claim 12 wherein said friction signal is determined in accordance with the relationships:

$$2f_1 = \frac{1}{N_d} \sum_{i=1}^{i=N_d} F_i \Big|_{v<-VT} - \frac{1}{N_w} \sum_{i=1}^{i=N_w} F_i \Big|_{v>+VT},$$

$$F_{avg} = \frac{1}{N_d + N_w} \sum_{i=1}^{i=N_d+N_w} F_i, \text{ and,}$$

$$f = \frac{f_1}{F_{avg}}, \text{ wherein:}$$

$f_1$=friction signal
$N_d$=number of scans in closing direction
$N_w$=number of scans in opening direction
$F_i$=sensed force signal values
v=gap change velocity
$V_T$=gap change velocity threshold
$F_{avg}$=average of sensed force signals
f=per unit friction signal.

15. The invention in accordance with claim 13 wherein said friction signal is determined in accordance with the relationships:

$$2f_1 = \frac{1}{N_d} \sum_{i=1}^{i=N_d} F_i \Big|_{v<-VT} - \frac{1}{N_w} \sum_{i=1}^{i=N_w} F_i \Big|_{v>+VT},$$

$$F_{avg} = \frac{1}{N_d + N_w} \sum_{i=1}^{i=N_d+N_w} F_i, \text{ and,}$$

$$f = \frac{f_1}{F_{avg}}, \text{ wherein:}$$

$f_1$=friction signal
$N_d$=number of scans in closing direction
$N_w$=number of scans in opening direction
$F_i$=sensed force signal values
v=gap change velocity
$V_T$=gap change velocity threshold
$F_{avg}$=average of sensed force signals
f=per unit friction signal.

16. The method in accordance with claim 1 wherein said friction signal has a value established as a function of said velocity signal.

17. The method in accordance with claim 16 wherein the relationship between said friction signal and said velocity signal is governed by the relationships:

$$f = f_{max} \text{ when } |v| \geqq |V_T|$$

$$f = f_{max} \cdot e^{-t/T} \text{ when } |v| < |V_T|$$

where:

$f_{max}$=per unit friction signal maximum value
v=gap change velocity
$V_T$=gap change velocity threshhold
t=time elapsed since $|v|$ fell below $|V_T|$
T=friction decay time constant
f=per unit friction signal
e=mathematical constant.

18. The invention in accordance with claim 17 wherein said friction signal is determined in accordance with the relationships:

$$2f_1 = \frac{1}{N_d} \sum_{i=1}^{i=N_d} F_i \Big|_{v<-VT} - \frac{1}{N_w} \sum_{i=1}^{i=N_w} F_i \Big|_{v>+VT},$$

$$F_{avg} = \frac{1}{N_d + N_w} \sum_{i=1}^{i=N_d+N_w} F_i, \text{ and,}$$

$$f_{max} = \frac{f_1}{F_{avg}}, \text{ wherein:}$$

$f_1$=friction signal
$N_d$=number of scans in closing direction
$N_w$=number of scans in opening direction
$F_i$=sensed force signal values
v=gap change velocity
$V_T$=gap change velocity threshold
$F_{avg}$=average of sensed force signals $f_{max}$ = per unit friction signal maximum value.

19. The method in accordance with claim 16 wherein, in a mill stand having the means for adjusting the gap and the means for sensing the roll separation force on the same side of the roll gap, the step of combining includes subtracting the friction signal from the sensed force signal when the roll gap is being decreased and adding the friction signal to the sensed force signal when the roll gap is being increased.

20. The method in accordance with claim 16 wherein, in a mill stand having the means for adjusting the gap and the means for sensing the roll separation force on opposite sides of the roll gap, the step of combining includes adding the friction signal to the sensed force signal when the roll gap is being decreased and subtracting the friction signal from the sensed force signal when the roll gap is being increased.

* * * * *